United States Patent [19]

Avidan et al.

[11] Patent Number: 4,784,748

[45] Date of Patent: Nov. 15, 1988

[54] FCC UNIT COMBINED WITH A CIRCULATING FLUID BED COMBUSTOR

[75] Inventors: Amos A. Avidan; Susan P. Donnelly, both of Yardley, Pa.; Frederick J. Krambeck, Cherry Hill, N.J.

[73] Assignee: Mobil Oil Corporation, New York, N.Y.

[21] Appl. No.: 113,318

[22] Filed: Oct. 28, 1987

[51] Int. Cl.[4] ..... C10G 11/18

[52] U.S. Cl. ..... 208/120; 208/113; 208/159; 208/160; 208/164

[58] Field of Search ..... 208/113, 120, 164, 159, 208/160

[56] References Cited

U.S. PATENT DOCUMENTS

| | | | |
|---|---|---|---|
| 2,399,050 | 4/1946 | Martin | 422/144 |
| 2,732,330 | 1/1956 | Krebs et al. | 208/127 |
| 2,742,403 | 4/1956 | Nicholson et al. | 208/161 |
| 2,862,871 | 12/1958 | Smith | 208/127 |
| 2,889,269 | 6/1959 | Nicholson | 208/127 |
| 2,906,703 | 9/1959 | Dalla Valle | 208/127 |
| 3,162,593 | 12/1964 | Persyn | 208/127 |
| 3,516,786 | 6/1970 | Maher et al. | 423/329 |
| 3,717,438 | 2/1973 | Schmalfeld et al. | 422/144 |
| 3,808,326 | 4/1974 | McDaniel et al. | 423/329 |
| 4,160,743 | 7/1979 | Kelley | 208/160 |
| 4,269,696 | 5/1981 | Metrailer | 208/120 |
| 4,311,580 | 1/1982 | Bartholic | 208/91 |
| 4,331,529 | 5/1982 | Lambert et al. | 208/127 |
| 4,368,114 | 1/1983 | Chester et al. | 208/120 |
| 4,400,262 | 8/1983 | Bearden, Jr. et al. | 208/127 |
| 4,426,359 | 1/1984 | Woebcke et al. | 422/145 |
| 4,437,979 | 3/1984 | Woebcke et al. | 208/153 |
| 4,693,809 | 9/1987 | Bartholic et al. | 208/127 |

OTHER PUBLICATIONS

An Overview of Commercial Circulating Fluidized Bed Boilers, J. Yerushalmi, First Inter. Conf. on Circulating Fluidized Beds, Halifax, Nova Scotia, Canada, Nov. 18–20, 1985.

Ind. Eng. Chem., N. Y. Chen & S. J. Lucki, Ind. Eng. Chem., Process Des. Dev. 1986, 25, 814–820.

*Primary Examiner*—Anthony McFarlane

*Attorney, Agent, or Firm*—Alexander J. McKillop; Michael G. Gilman; Richard D. Stone

[57] ABSTRACT

The invention combines two unit operations i.e. fluid catalytic cracking (FCC) and circulating fluid bed (CFB) boiler technologies. The circulating solid inventory of the CFB boiler is introduced to the bottom of a conventional FCC unit to supply the endothermic heat of reaction. A once-through FCC catalyst is introduced under high-temperature, short residence time conditions whereby improved yields are achieved through the reduction of coke made in the FCC unit.

13 Claims, 2 Drawing Sheets

FCC UNIT COMBINED WITH A CIRCULATING FLUID BED COMBUSTOR

BACKGROUND OF THE INVENTION

1. Field of the Invention

This invention is concerned with catalytic cracking processes, specifically fluid catalytic cracking (FCC) processes of high-temperature, short residence time to considerably lower coke make in the FCC unit.

2. Description of the Prior Art

The field of catalytic cracking has undergone progressive development since 1940. The trend of development from the thermofor catalytic cracker (TCC) to the widespread use of the fluid catalytic cracking (FCC) process is evident from both patent and technical literature. The trend in FCC processes has been to all riser cracking, use of zeolite-containing catalyst, heat balanced operation, and complete combustion of CO to $CO_2$ within the regenerator. A typical FCC unit and process including a regenerator for the spent catalyst, is disclosed in U.S. Pat. No. 4,368,114, the disclosure of all of which is herein incorporated by reference. This patent, typical of FCC processes, utilizes the concept of a circulating catalyst inventory wherein catalyst is contacted with the feedstock under catalytic cracking conditions so as to form a mixture of products as the catalyst and feedstock move through the reaction zone, typically upwards in a riser reactor. During the aforementioned catalytic cracking, coke is deposited on the catalyst thereby reducing its activity. This coke laden catalyst, also known as spent catalyst, is separated from the reaction products, either by cyclonic separator means and/or by stripping with a stripping gas and is then in a state suitable for regeneration. The spent catalyst is fed to a regeneration unit where it is contacted with an oxygen-containing combustion gas under conditions of time, temperature and pressure sufficient to reduct the coke on the catalyst to about 0.25% or less while forming combustion products comprising CO and $CO_2$. At least a portion of the resulting regenerated catalyst is again contacted with fresh feedstock, thereby completing the cycle.

As is evident from the foregoing, the regeneration process is not only energy intensive but produces undesirable combustion products such as CO and $CO_2$. Additionally, the conventional FCC units operate under such conditions whereby approximately 5% of the feedstock is burned in a regenerator to supply the heat of cracking. Thus, the heat balance in conventional FCC units are inefficient and reduce the ultimate FCC yield as well as greatly limiting the operational flexibility of conventional FCC processes.

Thus, it would be desirable to develop a FCC process which avoids the aforementioned disadvantages of conventional FCC processes.

OBJECTS OF THE INVENTION

It is an object of the invention to reduce the coke make in FCC units as a result of catalytic cracking of a hydrocarbon feedstock.

It is a further object of the invention to increase the operational flexibility of FCC processes by using low-quality and low-value fuels, instead of FCC feed, to supply the heat requirements of the FCC process.

It is a further object to dispose of sludges, waste, and the like in an enviromentally acceptable way.

It is a further object to solve the foregoing and other objects by providing an apparatus and process whereby a circulating solid, such as limestone/ash from a circulating fluid bed at (CFB) boiler, at elevated temperatures is conveyed from the CFB boiler to the riser reaction zone of an FCC unit together with a catalytic cracking catalyst.

It is a further object of this invention to reduce the coke make, and hence increase the yield by employing high cracking temperatures and very short contact times in the FCC unit.

SUMMARY OF THE INVENTION

The present invention is directed to accomplishing the foregoing objects by providing an improved apparatus and process wherein the hot circulating solids of an CFB combustor are introduced to the lower portion of a riser reactor of an FCC unit, together with feedstock and a catalyst. The present invention is also directed to improving yields of products formed by the use of an FCC unit and process by high-temperature, short residence time contact of a feedstock with a high-activity, once-through catalyst.

DETAILED DESCRIPTION OF THE INVENTION

The present invention combines two unit operations, fluid catalytic cracking (FCC) and circulating fluid bed (CFB) combustor technology. The combined process increases yields of desirable products e.g. light fuel, while eliminating refinery waste streams in an environmentally acceptable way.

As is well known, catalytic cracking is an endothermic reaction and currently requires complex and expensive regenerating equipment to burn the approximately 5 wt. % of the feed which is turned into coke during the catalytic cracking. In order to increase the yield of economically desirable products it has been proposed to reduce the coke by utilization of a once-through catalyst in FCC processes. However, a problem with such proposals is the introduction of the required reaction heat to the FCC reactor in the absence of the heat supplied by regenerated catalyst.

The invention overcomes these prior art problems through a unique synergistic coupling of a fluid catalytic cracking unit and the circulating fluid bed combustor technology.

As is well known, CFB boilers employ hot circulating inert solids, such as limestone/ash to satisfy steam needs. Circulating fluidized combustors and boiler technology is currently undergoing rapid commercialization with over 50 units operating, or in various stages of construction within the United States. Prior to 1979 there were no CFB units in operation. CFB technology was recently reviewed in the "First International Conference on Circulating Fluidizing Bed", held in Halifax, Nova Scotia, Nov. 18–20, 1985 wherein a review paper by Joseph Yerushalmi was presented. The foregoing paper of J. Yerushalmi is herein incorporated, in its entirety, by reference.

Figure 1:
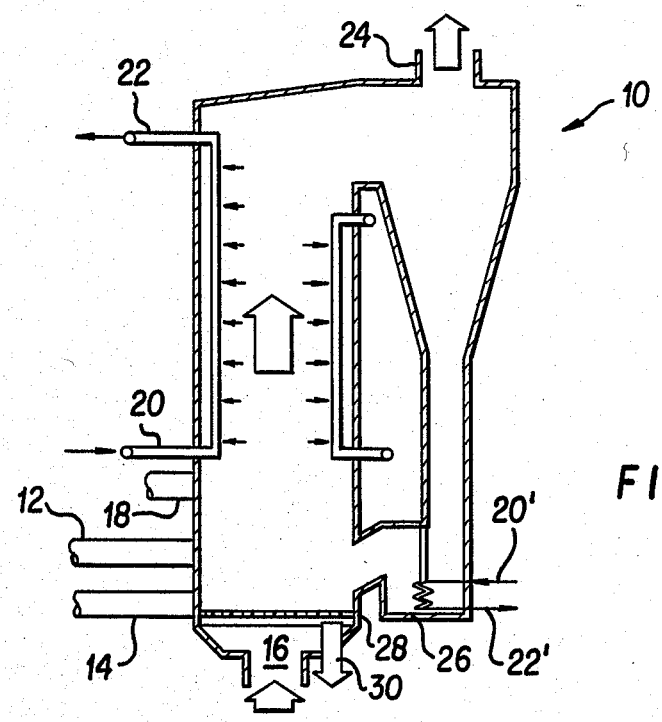
FIG. 1 is a simplified schematic representative of a typical circulating fluid-bed (CFB) combustor.

A CFB boiler can handle a wide variety of fuels such as petroleum coke, fuel gas, heavy fuel oil, coals of various quality and a variety of sludges. Despite the low quality of potential fuel, $SO_2$ and $NO_x$ emissions are kept low and environmentally acceptable. Sulfur removal is achieved by the use of limestone, which at the elevated temperatures of the CFB, typically about 1500° F. to about 1600° F., coupled the sulfur. The low $NO_x$ emissions are achieved by low combustion temperatures and staged combustion. A typical circulating fluid-bed combustor is illustrated in FIG. 1 wherein the combustor 10 is fed with a source of inert particles such as crushed limestone, through conduit 12 and fuel through conduit 14 together with a source of primary air through conduit 16 which ordinarily provides about 40–80% of the air required for combustion. A source of secondary air is fed through conduit 18 which provides the remaining 20–60% of the air necessary for combustion. Water circulating through heat exchangers 20, 20' is turned into steam when exiting conduits 22, 22' of heat exchangers 20, 20'. Gaseous products of combustion (flue gas) are removed through outlet 24 of combustor 10 with a recycle of the limestone and incompletely burned fuel occurring in conduit 26. Ash may be removed through gate 28 and through conduit 30 to a site remote from combustor 10. The fuel fed through conduit 14 may include hazardous wastes and sludges which are otherwise expensive to dispose of. The combustor can also burn low-value petroleum coke, or other refinery products. For example, in refineries limited by fuel gas production, excess fuel gas, such as FCC fuel gas, can be burned in the CFB combustor in combination with other fuels.

The only obstacle which has prevented wide spread installation of CFB boilers has been the relatively high initial investment cost. Despite very favorable economics in rate of return, refiners find themselves limited to available capital for use elsewhere.

The invention implements CFB boiler technology by coupling it to another refinery unit, the fluid catalytic cracker (FCC). The FCC process requires heat which is currently supplied by burning coke, manufactured in the process, in a separate regenerator, wherein approximately 5 wt. % of the FCC feed is converted to coke. This coke formation results not only in yield loss but also presents problems of "heat balancing" the FCC unit which can limit the unit and its ability to handle higher coking feeds or operating conditions.

The CFB boiler manufacturers heat, which is typically used for producing steam for power production and other uses. However, in the present invention, part, or all of this heat, can be transferred to a unit such as the FCC by circulating the hot solids from the CFB boiler. The solids are composed primarily of sulfated limestone and ash and can be used in the particle size distribution of typical FCC catalyst. The typical FCC catalyst has a particule size range of 0.05–150 μm.

The typical combustion temperature of the inert particles in a CFB boiler is elevated, on the order of about 1500° F. to about 1560° F. Although regeneration of a conventional FCC catalyst may be possible in a CFB boiler, catalyst makeup will be high due to excessive steaming of the zeolite catalysts used in FCC.

Thus, in a particularly preferred embodiment of the invention, a once-through FCC catalyst will be used, i.e., substantially 100% of the catalyst contacting the hydrocarbon will be virgin catalyst. The term "virgin catalyst" encompasses catalyst which has been pretreated, i.e., base exchanged but does not encompass catalyst which has been regenerated. Advantageously such a catalyst would possess hydrodynamic properties which would prevent it from entering the CFB boiler. In the present invention an FCC catalyst in the pure, small crystal form such as a preparation of a small Y zeolite as reported in U.S. Pat. Nos. 3,808,326 and 3,516,786, the disclosure of all of which is herein incorporated by reference, is used. Optionally a solution of zeolite crystals may be utilized. Small zeolite crystal size, preferably less than 0.05 μm, tends to reduce coking and enhance catalyst activity. In addition, catalyst makeup requirements are lower. However, it is to be understood that conventional FCC catalysts such as REY, USY and combinations of REY-USY, and additives such as ZSM-5, ZSM-11, ZSM-12, ZSM-23, ZSM-35, ZSM-38 and mixtures thereof may be employed in the invention.

The use of high cracking temperatures and very short contact times to reduce coking and non-selective thermal cracking is an advantage of the present process and thus represents a particularly preferred embodiment of the invention. For example, short residence times of the catalyst in an FCC riser on the order of about 50 milliseconds to about 2 seconds, preferably about 150 milliseconds to about 2 seconds are preferred. Severe cracking conditions at high temperatures of about 950° F. to about 1500° F., preferably about 1000° F. to about 1200° F. produce non-selective thermal cracking. Additional data based on a once-through, non-regenerated cracking are described by N.Y. Chen and S. J. Lucki in Ind. Eng. Chem., Process Des. Dev. 1986, 25, 814–820, the disclosure of all of which is herein incorporated by reference.

Figure 2:
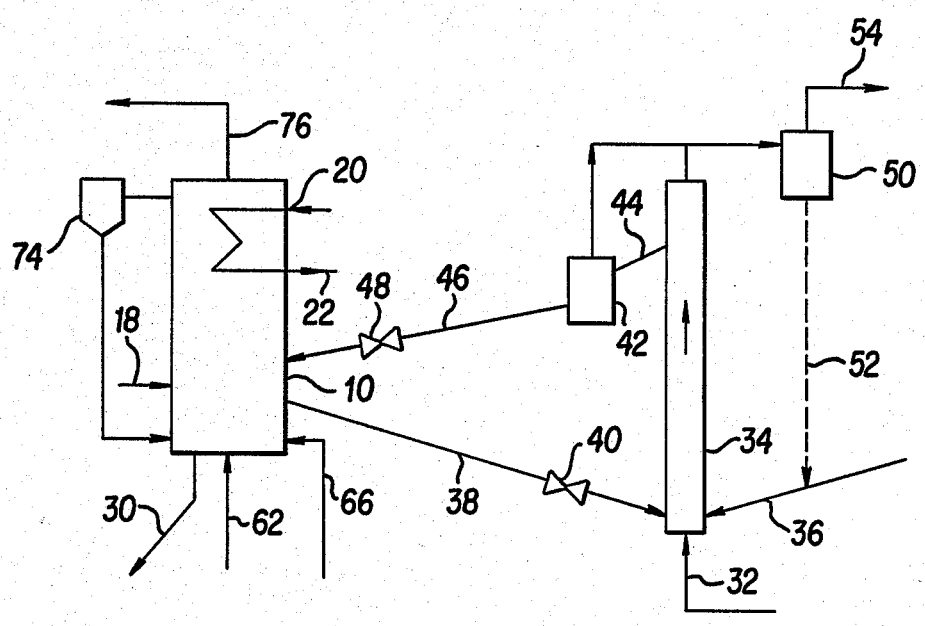
FIG. 2 is a schematic representation of a combined FCC riser-CFB combustor.

In one embodiment of the invention (FIG. 2), a conventional FCC feed such as a gas oil, or resid, is introduced through conduit 32 to the bottom of riser 34. Fresh FCC catalyst of the type mentioned hereinabove may be introduced through conduit 36 under catalytic cracking conditions. If the fresh FCC catalyst is in the conventional form, i.e., on a support, it could be premixed with the hot solids, e.g. limestone/ash, exiting combustor 10, through conduit 38 and flow control valve 40, so as to enter the bottom of riser 34. If the FCC catalyst is in the form of a liquid solution of crystals it may be premixed with the FCC feed entering through conduit 32 or with the dispersion entering conduit 56 steam at the bottom of riser 34.

If the pure zeolite crystals are used, they will readily separate from the larger and heavier limestone in conventional separation devices, such as cyclone 50 near the outlet portion of riser 34. The spent limestone can be sent to a stripper 42 through conduit 44. Stripper 42 is similar to conventional FCC strippers utilizing steam or other stripping gas. Upon stripping, the spent limestone can be returned via conduit 46 through flow control valve 48 to combustor 10. The spent FCC catalyst is carried with the products of catalytic cracking and can be separated in external separator 50. Optionally, at least some of the spent catalyst can be sent back to the fresh catalyst makeup via conduit 52 or withdrawn to disposal (not shown). Some, or all of the FCC catalyst may be removed from the system through existing slurry settlers (not shown) in conventional main column bottoms (not shown). The products are removed via conduit 54 to downstream handling means such as the aforementioned main column (not shown).

Figure 3:
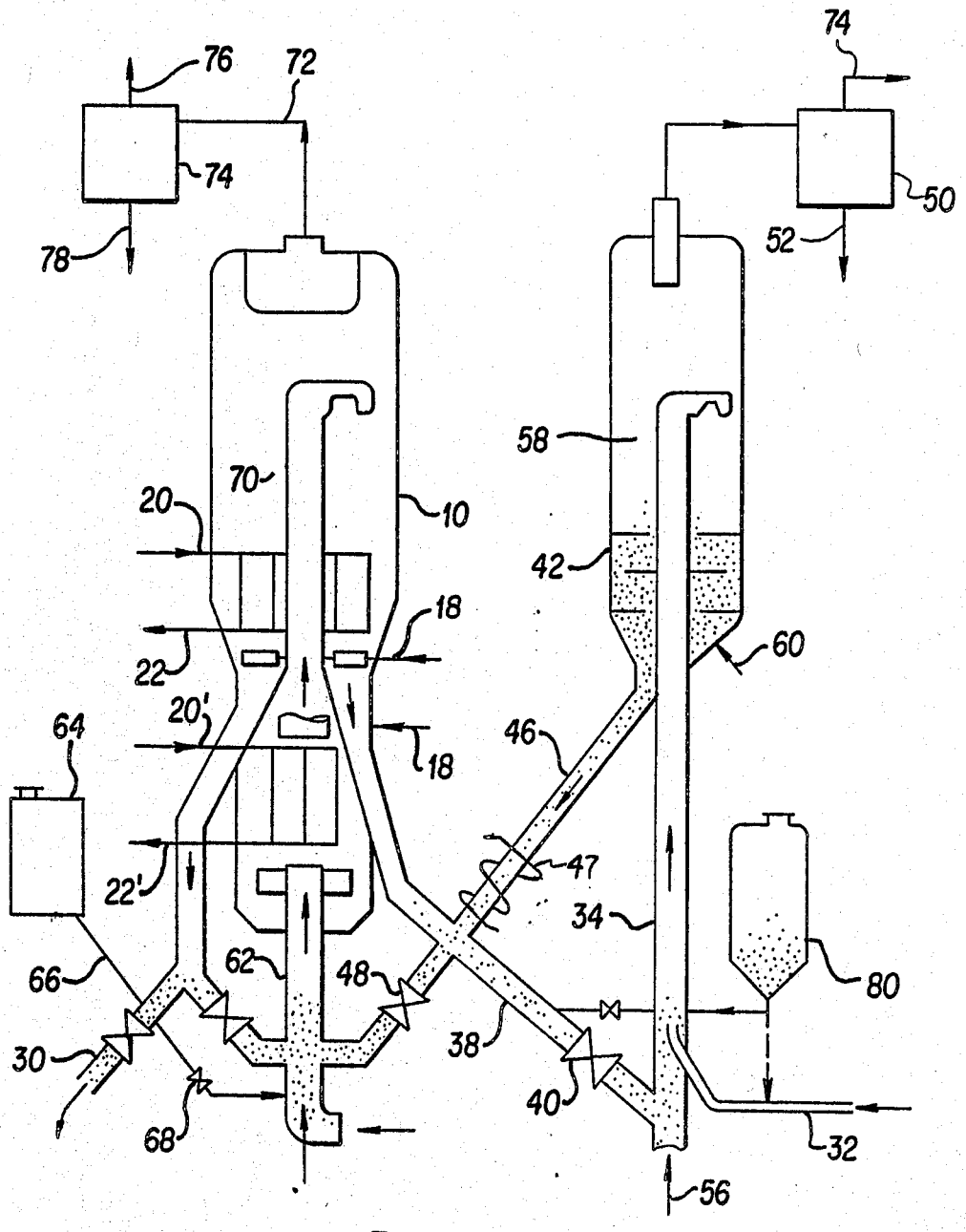
FIG. 3 is a schematic representation of an existing FCC regenerator revamped to accomodate a (CFB) combustor.

In a preferred embodiment of the invention an existing FCC riser regenerator can be easily connected to a CFB boiler as illustrated in FIG. 3. Thus riser 34 will be fed with an FCC feed through conduit 32 and hot inert solids, such as limestone/ash from combustor 10, through conduit 38 and flow control valve 40. Fluidizing steam may be fed to the bottom of riser 34 through conduit 56. The spent limestone/ash is separated from the reaction products and FCC catalyst by separator means such as one or more cyclones (not shown) in FCC reactor plenum 58. The spent limestone/ash is stripped in stripper 42 by means of a stripping gas entering stripper 42 through conduit 60 and the stripped limestone/ash returned via conduit 46 through flow control valve 48 to re-enter the bottom of combustor 10.

Re-entry of this stripped limestone/ash to combustor 10 is preferably achieved by fluidizing the spent limestone with the gaseous or liquid fuel entering combustor 10 through riser 62. Makeup limestone/solid fuel from source 64 may advantageously be introduced through conduit 66 through flow control valve 68 into riser 62. A source of secondary air, as described with relation to FIG. 1, may be introduced through conduit 18 of FIG. 3. Heat exchangers 20, 20' are used to produce steam exiting the heat exchangers through conduit 22, 22'. An external heat exchanger 47 may also be placed on the recirculating standpipe. The solid limestone/ash and incompletely combusted fuel is separated from the flue gas by separator means such as one or more cyclones (not shown) in the combustion plenum 70. The flue gas exiting combustor 10 through conduit 72 may be further separated by separation means 74 before being discharged through conduit 76. The fines removed from flue gas by separator 74 may be withdrawn through conduit 78 to disposal or optionally to recycle to combustor 10. A source of fresh or makeup catalyst is shown at 80.

As noted from the foregoing description of the invention the coupling of a CFB combustor and an FCC unit results in a process wherein yield of product is increased by reducing the coke make in the FCC unit. Additionally, the heat required in the endothermic reactions of the riser unit may conveniently be supplied by the circulating solids of the CFB unit while maintaining the flexibility of the FCC process.

The present invention thus permits modification of existing FCC units whereby the capital investment will be much lower than that required for a new conventional FCC/regenerator unit.

The foregoing description of the invention is offered to illustrate the invention but it is obvious that changes may be made without departing from the spirit thereof and the invention includes all such modifications.

We claim:

1. A process for the catalytic cracking of a hydrocarbon feedstock comprising:

(a) feeding a hydrocarbon feedstock to a catalytic cracking zone;

(b) introducing inert particles, from a circulating inventory of inert solids of a circulating fluid-bed combustor, into the reaction zone, at a temperature greater than about 950° F. in the presence of the feedstock and a once-through zeolite catalyst;

(c) catalytically cracking the feedstock to form cracked products;

(d) separating the inert particles from the catalyst and the cracked product; and (e) returning the inert particles to the circulating fluid-bed combustor.

2. The process of claim 1, including the step of using substantially 100% virgin catalyst.

3. The process of claim 1, including the step of feeding a fuel selected from the group consisting of sludges and hazardous waste to said circulating fluid-bed combustor.

4. The process of claim 3, wherein combustion of said fuel produces temperatures in the circulating fluid bed combustor in the range of from about 1500° F. to about 1600° F.

5. The process of claim 1, wherein the zeolite catalyst is selected from the group consisting of REY, USY and combinations of REY and USY.

6. The process of claim 5, wherein the zeolite catalyst includes a zeolite selected from the group consisting of ZSM-5, ZSM-11, ZSM-12, ZSM-23, ZSM-35, ZSM-38 and mixtures thereof.

7. The process of claim 1, wherein the catalyst is Zeolite Y in the form of zeolite crystals.

8. The process of claim 5, wherein the catalyst is Zeolite Y and is present in the form of particles.

9. The process of claim 8, wherein the particles have a particle size within the range of about 0.05 to about 150 μm.

10. The process of claim 1, wherein said catalyst and feedstock are present in said cracking zone for a period of time of about 50 millisecond to about 2 seconds.

11. The process of claim 10, wherein the period of time is about 150 milliseconds to about 2 seconds.

12. The process of claim 1, wherein the temperature is about 950° F. to about 1500° F.

13. The process of claim 1, wherein the temperature is about 1000° F. to about 1200° F.

* * * * *